US007387223B2

(12) United States Patent
Misumi

(10) Patent No.: US 7,387,223 B2
(45) Date of Patent: Jun. 17, 2008

(54) SYNTHETIC RESIN CLIP AND HANGER WITH SYNTHETIC RESIN CLIPS

(76) Inventor: Hideo Misumi, 3-4-9, Nagaremachi, Hirano-ku, Osaka-shi, Osaka-fu (JP)

( * ) Notice: Subject to any disclaimer, the term of this patent is extended or adjusted under 35 U.S.C. 154(b) by 144 days.

(21) Appl. No.: 11/209,821

(22) Filed: Aug. 24, 2005

(65) Prior Publication Data

US 2006/0042050 A1 Mar. 2, 2006

(30) Foreign Application Priority Data

Aug. 26, 2004 (JP) ..... 2004-246786

(51) Int. Cl.
*A41D 27/22* (2006.01)

(52) U.S. Cl. ..... 223/96; 223/85; 223/93; 223/95; 24/326; 24/327; 24/335; 24/338

(58) Field of Classification Search ..... 223/85, 223/88, 90, 91, 93, 95, 96; 24/30.5 R, 499, 24/500, 501, 504, 508, 511, 326, 327, 331, 24/335, 338

See application file for complete search history.

(56) References Cited

U.S. PATENT DOCUMENTS 3,456,262 A * 7/1969 Coon ..... 24/501
3,946,915 A * 3/1976 Crane ..... 223/96
4,382,531 A * 5/1983 Bisk et al. ..... 223/91
4,878,276 A * 11/1989 Morrish et al. ..... 24/511
5,241,728 A * 9/1993 Hunter ..... 24/511
5,318,292 A * 6/1994 De Marco ..... 24/3.11
5,402,558 A * 4/1995 Santapa ..... 24/511
6,050,462 A * 4/2000 Petrou et al. ..... 223/96
6,098,254 A * 8/2000 Willinger ..... 24/501
6,119,906 A * 9/2000 Bond et al. ..... 223/96
2002/0023936 A1* 2/2002 Batts ..... 223/96
2004/0099700 A1* 5/2004 Misumi ..... 223/96

FOREIGN PATENT DOCUMENTS

JP 8-205984 8/1996
JP 10000147 A * 1/1998

* cited by examiner

*Primary Examiner*—Gary L. Welch
*Assistant Examiner*—Nathan E Durham
(74) *Attorney, Agent, or Firm*—Wenderoth, Lind & Ponack, L.L.P.

(57) ABSTRACT

In order to provide a synthetic resin clip and a hanger with synthetic resin clips that are high in safety and can yet be produced at low cost, a synthetic resin clip and synthetic resin clips to be provided on a hanger are arranged with engaging portions being formed on inner surface portions of tips of a synthetic resin spring, which is formed in a "U" shape by being folded back at an intermediate portion, window holes for sliding of molding dies being formed on outer portions of clip members in order to form receiving portions, engaging with the engaging portions, at inner portions of the clip members, insertion spaces, into which the tip portions of the synthetic resin spring are inserted, being formed in the direction of sliding of the dies between upper edges of the window holes and upper end portions of the receiving portions, and fly-apart preventing bars being disposed across the upper and lower edges of the window holes.

4 Claims, 9 Drawing Sheets

SYNTHETIC RESIN CLIP AND HANGER WITH SYNTHETIC RESIN CLIPS

BACKGROUND OF THE INVENTION

1. Field of the Invention

This invention relates to a synthetic resin clip and a hanger with synthetic resin clips.

2. Description of the Related Art

In general, clothes, etc., are delivered in the state of being hung on an above-mentioned hanger when being delivered from a manufacturer of the clothes, etc., to a trading firm or from a trading firm to a retail shop, and recently, in accordance with product liability laws, that is, so-called "PL laws," deliveries are made upon confirming by a metal detector that needles, etc., are not remaining in the clothes and other sewn products. With a synthetic resin clip, with which clamping portions of clip members are elastically urged in the direction of pressing against each other by a "U" shaped metal spring, the metal detector responds to the metal spring.

In order to accommodate for such a metal detector, an arrangement is used wherein a synthetic resin spring, which has elasticity, is folded back in a "U" shape at a central portion, and is formed of a composite material having high-density carbonate resin as the main component, is fitted into a synthetic resin clip, and such clips are mounted onto a hanger.

However, with this synthetic resin clip fitted with the synthetic resin spring made of a composite material having high-density carbonate resin as the main component, the synthetic resin spring breaks at the folded-back portion occasionally upon repeated use of the clip, and since pieces of the broken synthetic resin spring that fly apart may injure a hand, face, etc., there was an issue in terms of safety.

Though the covering of the synthetic resin spring in the process of molding the clip members may be considered, this may disable the release from a molding die or make the molding die become complicated in structure or increase the number of dies (number of die parts) etc., and thereby increase the initial cost or the running cost.

In view of these problems, the applicant of the present invention has priorly proposed in a synthetic resin clip, wherein clip members, each having a clamping portion formed at one end, are made to face each other, a synthetic resin spring, which is folded back and formed to a "U" shape, is fitted across the clip members, and the clip members are elastically urged in the direction in which clamping portions of both the clip members press against each other by the elastic force of the synthetic resin spring, an arrangement wherein engaging portions are formed on inner surface portions of tips of the synthetic resin spring, the clip members are provided with receiving portions, which engage with the engaging portions, and fly-apart preventing portions, each formed so as to extend from an operating portion to a position near the tip of the receiving portion, spaces for insertion of the engaging portions of the synthetic resin spring are formed between the tip portion sides of the receiving portions and the tip portion sides of the fly-apart preventing portions, and the tips of the receiving portions and the tips of the fly-apart preventing portions are formed so as not to overlap in a manner wherein there are no gaps or there are only slight gaps for enabling the sliding of dies for molding the clip members in a direction orthogonal to the direction of sliding the dies. The synthetic resin clip is shown in Japanese Patent No. 2956956.

With the synthetic resin clip proposed by the applicant of the present invention, since an opening that opens below each fly-apart preventing portion is opened across its entire width, when the synthetic resin spring breaks, the broken pieces thereof can fly out of the opening and fly apart to the surroundings. There was thus the possibility that safety could not be secured adequately.

This invention has been made in view of the above problem and an object thereof is to present a synthetic resin clip and a hanger with synthetic resin clips that are high in safety and yet can be produced at low cost.

SUMMARY OF THE INVENTIOIN

In order to achieve the above object, this invention provides a synthetic resin clip most mainly characterized in that engaging portions are formed on inner surface portions of tips of a synthetic resin spring, formed in a "U" shape by being folded back at an intermediate portion, window holes for sliding of molding dies are formed on outer portions of clip members in order to form receiving portions, which engage with the engaging portions, at inner portions of the clip members, insertion spaces, into which the tip portions of the synthetic resin spring are inserted, are formed in the direction of sliding of the dies between upper edges of the window holes and upper end portions of the receiving portions, fly-apart preventing bars are disposed across the upper and lower edges of the window holes, and the engaging portions of the synthetic resin spring are engaged with the receiving portions of the pair of clip members that are made to oppose each other face-to-face.

This invention's synthetic resin clip is also characterized in that die sliding slits are formed at the receiving portions opposing the fly-apart preventing bars and the pair of clip members are connected by a bendable thin member and are thereby made moldable integrally.

Also, this invention's hanger equipped with synthetic resin clip is most mainly characterized in being provided, at an arm having a hanging hook formed on a central portion, with synthetic resin clips, each arranged with engaging portions being formed on inner surface portions of tips of a synthetic resin spring, formed in a "U" shape by being folded back at an intermediate portion, window holes for sliding of molding dies being formed on outer portions of clip members in order to form receiving portions, which engage with the engaging portions, at inner portions of the clip members, insertion spaces, into which the tip portions of the synthetic resin spring are inserted, being formed in the direction of sliding of the dies between upper edges of the window holes and upper end portions of the receiving portions, fly-apart preventing bars being disposed across the upper and lower edges of the window holes, and the engaging portions of the synthetic resin spring being engaged with the receiving portions of the pair of clip members that are made to oppose each other face-to-face.

This invention's hanger equipped with synthetic resin clip is also characterized in that of each pair of clip members, connected by a bendable thin member, one clip member is integrally molded to a tip portion of the arm on the central portion of which the hanging hook is formed.

With the present invention, since the synthetic resin clip, comprising the pair of clip members and the synthetic resin spring, has the fly-apart preventing bare disposed across the upper and lower edges of the window holes in which the dies for forming the receiving portions of the clip members slide, when the synthetic resin spring breaks, the broken pieces thereof are received securely by the fly-apart preventing bars, the respective ends of which are connected to the window holes, and the flying apart of the broken pieces from the window holes can thus be prevented without fail.

A synthetic resin clip having a high degree of safety can thus be provided and a hanger with synthetic resin clips that is equipped with the above synthetic resin clips can also be made to have a high degree of safety.

Also, with the arrangement wherein the pair of clip members of the synthetic resin clip are connected by a bendable thin member and enabled to be integrally molded in a state in which the clip members are laid side-by-side, the molding can be performed simply in a single step, and since the clip members can be made to oppose each other accurately by bending at the thin member, a synthetic resin clip, synthetic resin clips that are integrally formed on an arm having a hanging hook formed at a central portion, and a hanger with synthetic resin clips can be assembled quickly and easily in a short time to enable the trouble and cost of production to be reduced significantly.

DESCRIPTION OF THE PREFERRED EMBODIMENTS

A synthetic resin clip by this invention and a hanger with clips, provided with the synthetic resin clips, shall be described as Embodiment 1 and Embodiment 2, respectively, based on the drawings.

Embodiment 1

Figure 1:
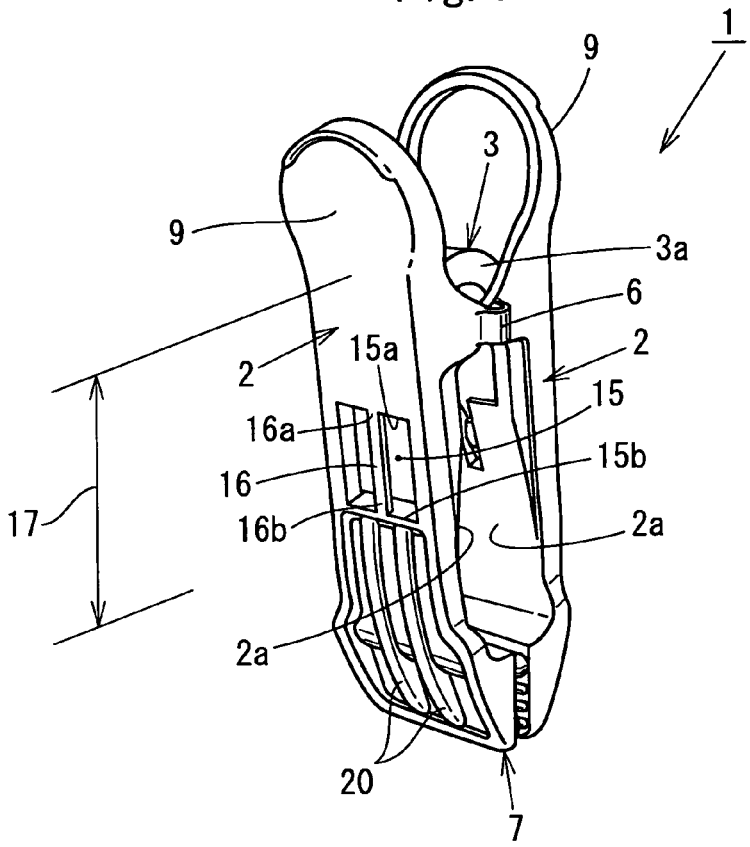
FIG. 1 is a perspective view of a synthetic resin clip.
Figure 2:
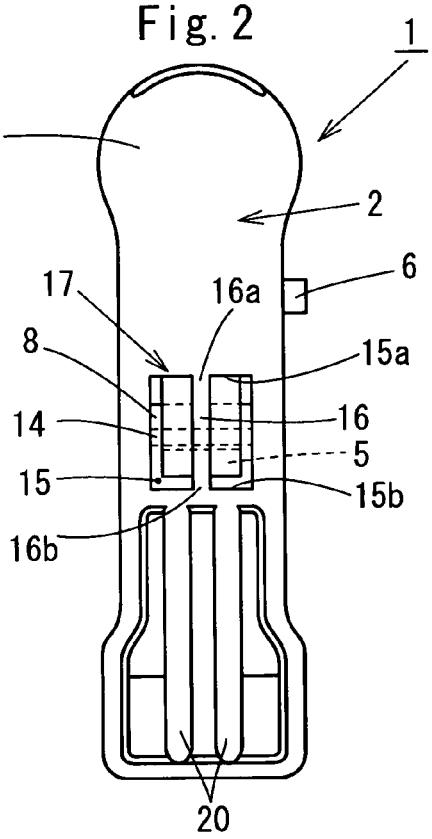
FIG. 2 is a front view of the synthetic resin clip.
Figure 3:
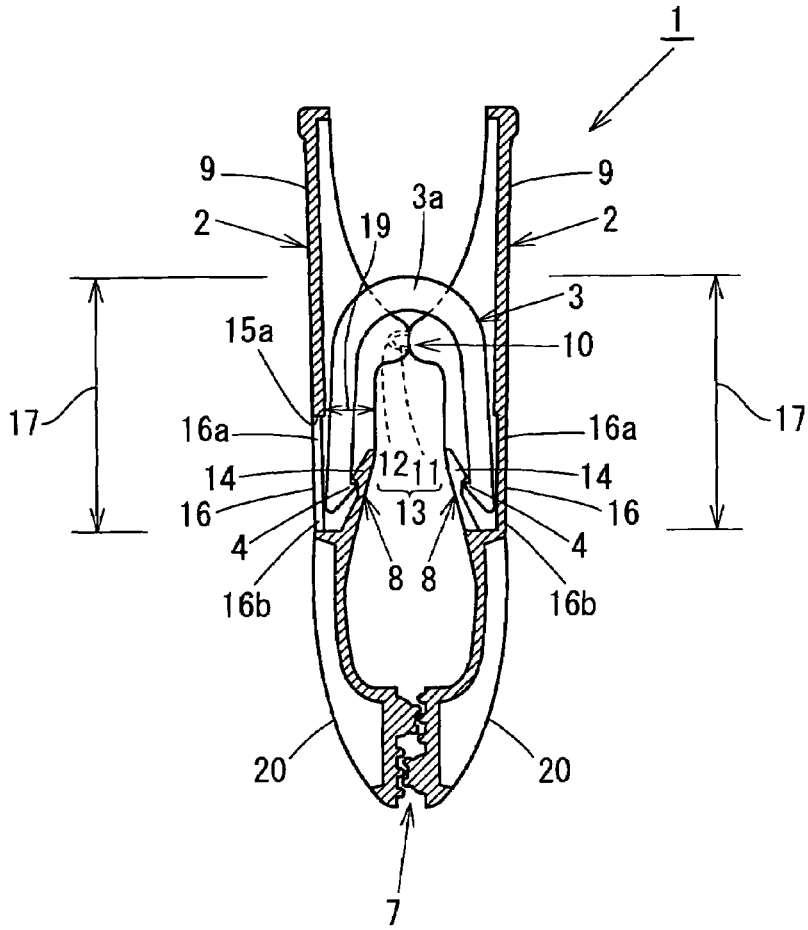
FIG. 3 is a longitudinal sectional view of the synthetic resin clip.
Figure 4:
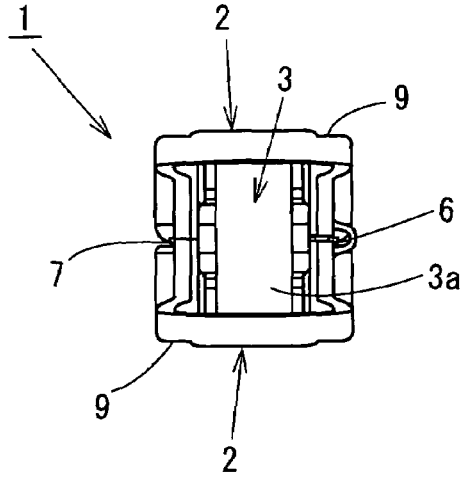
FIG. 4 is a plan view of the synthetic resin clip.
Figure 5:
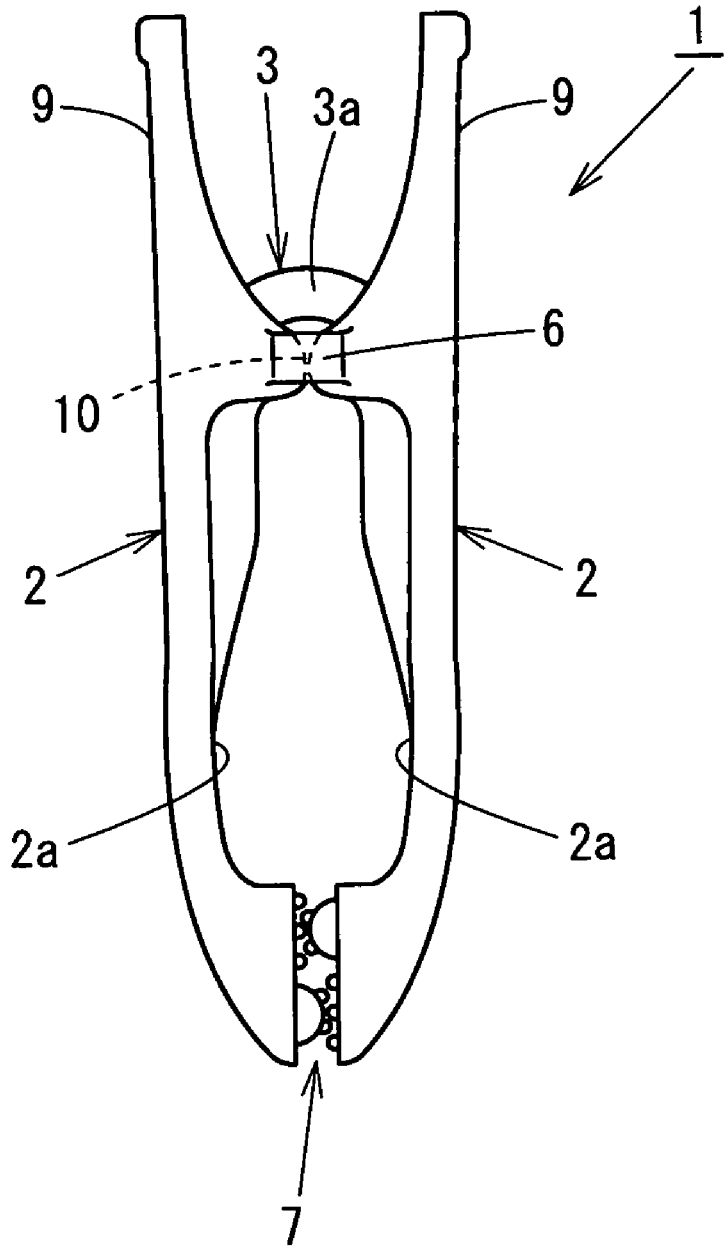
FIG. 5 is a right side view of the synthetic resin clip.
Figure 6:
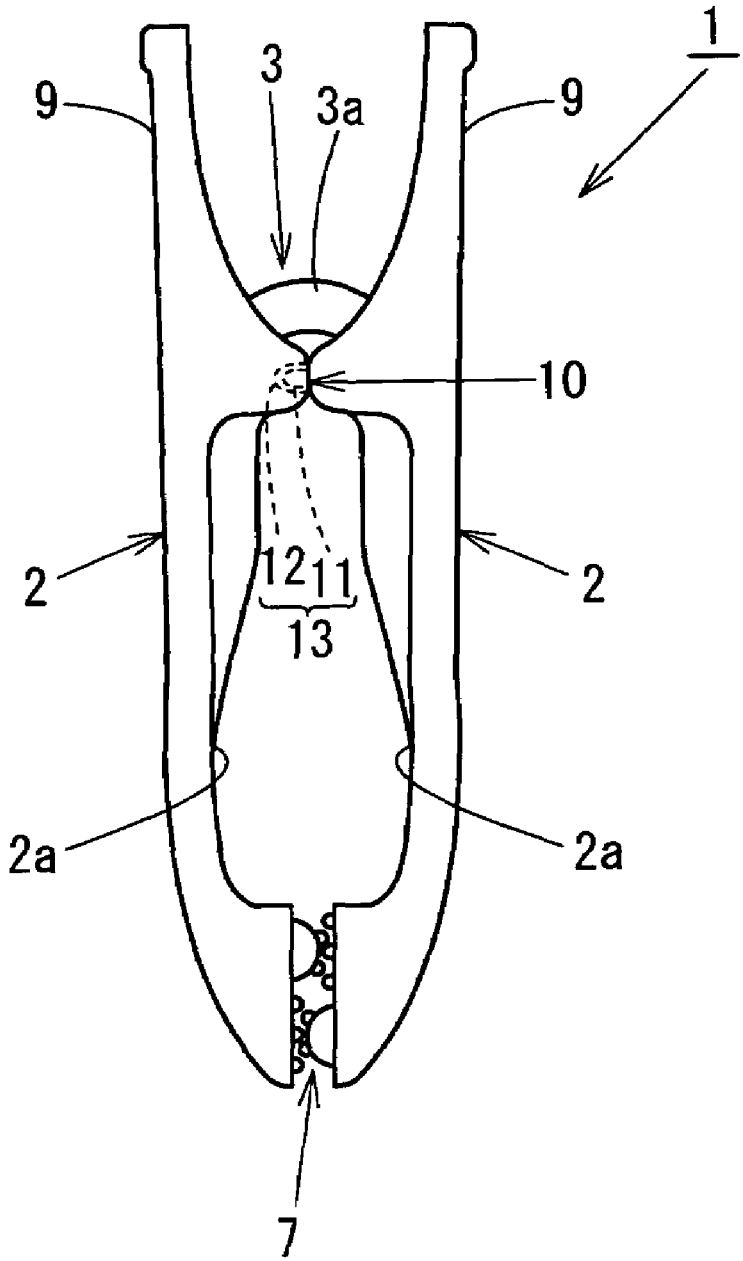
FIG. 6 is a left side view of the synthetic resin clip.
Figure 7:
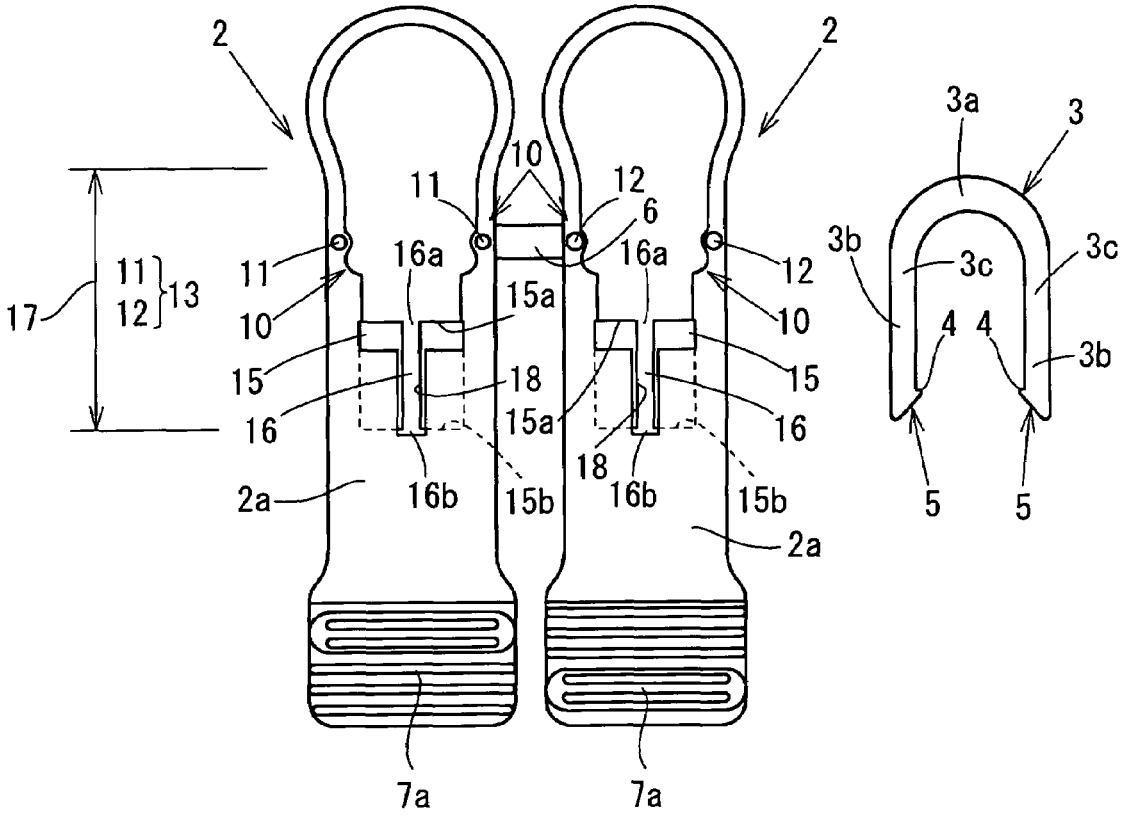
FIG. 7 is an exploded view of the synthetic resin clip prior to assembly.
Figure 8:
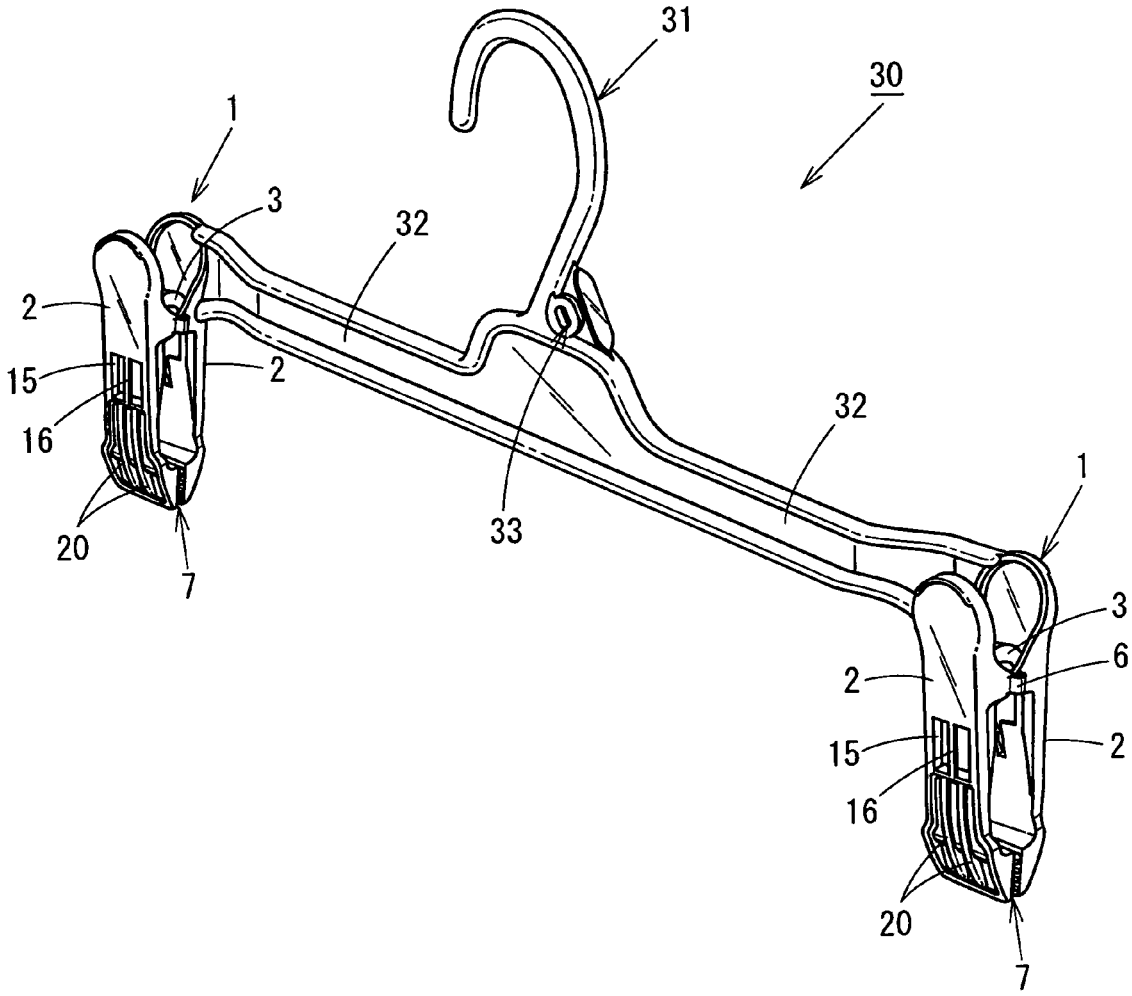
FIG. 8 is a perspective view of a synthetic resin hanger equipped with synthetic resin clips.
Figure 9:
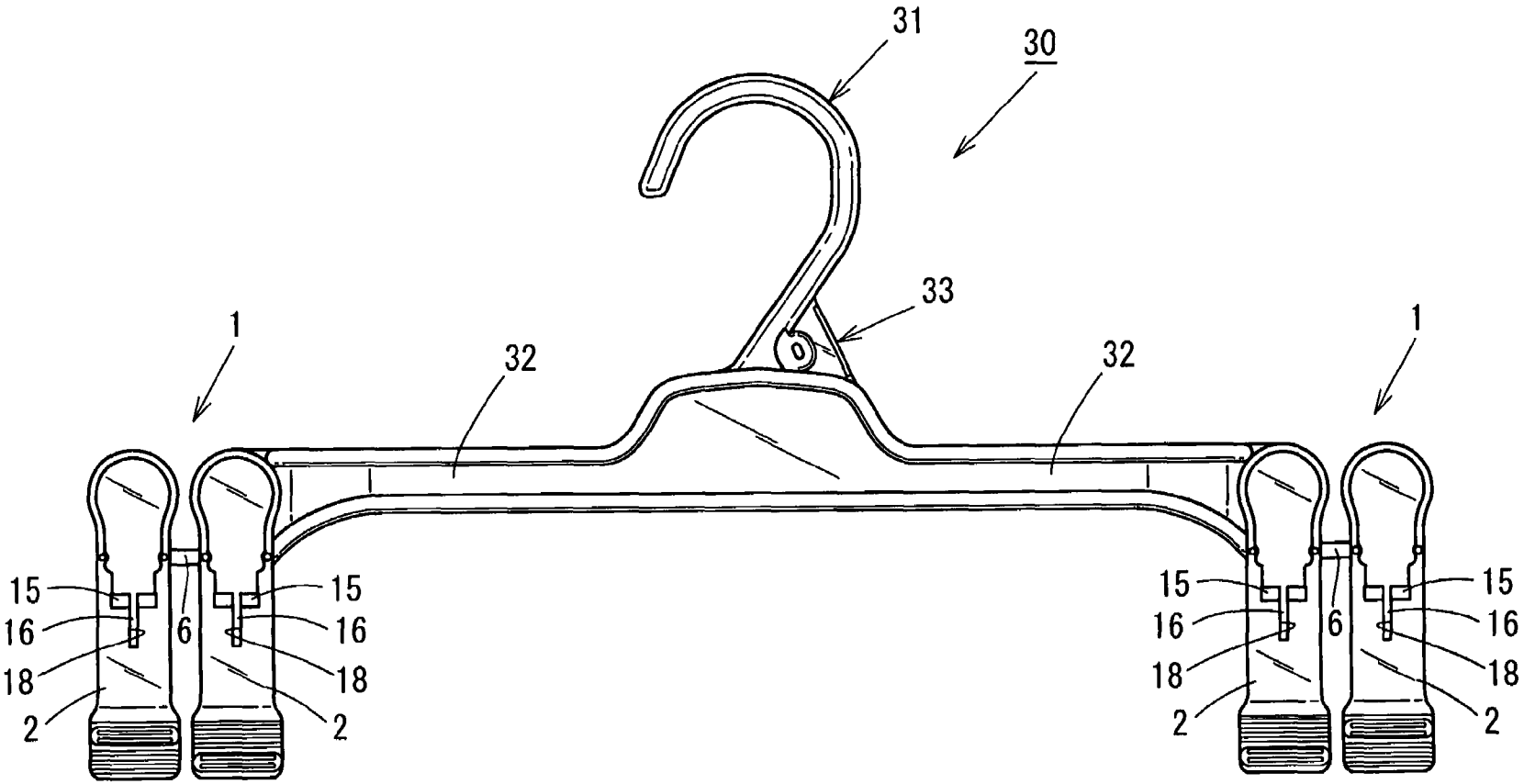
FIG. 9 is a front view of the synthetic resin hanger equipped with synthetic resin clips.
Figure 10:
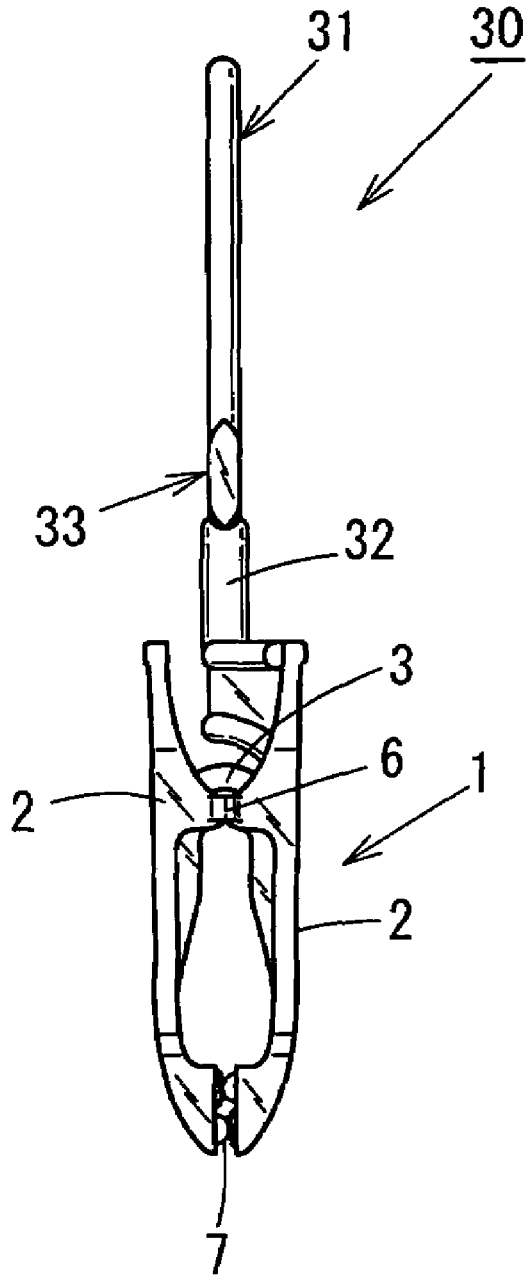
FIG. 10 is a side view of the synthetic resin hanger equipped with synthetic resin clips.
Figure 11:
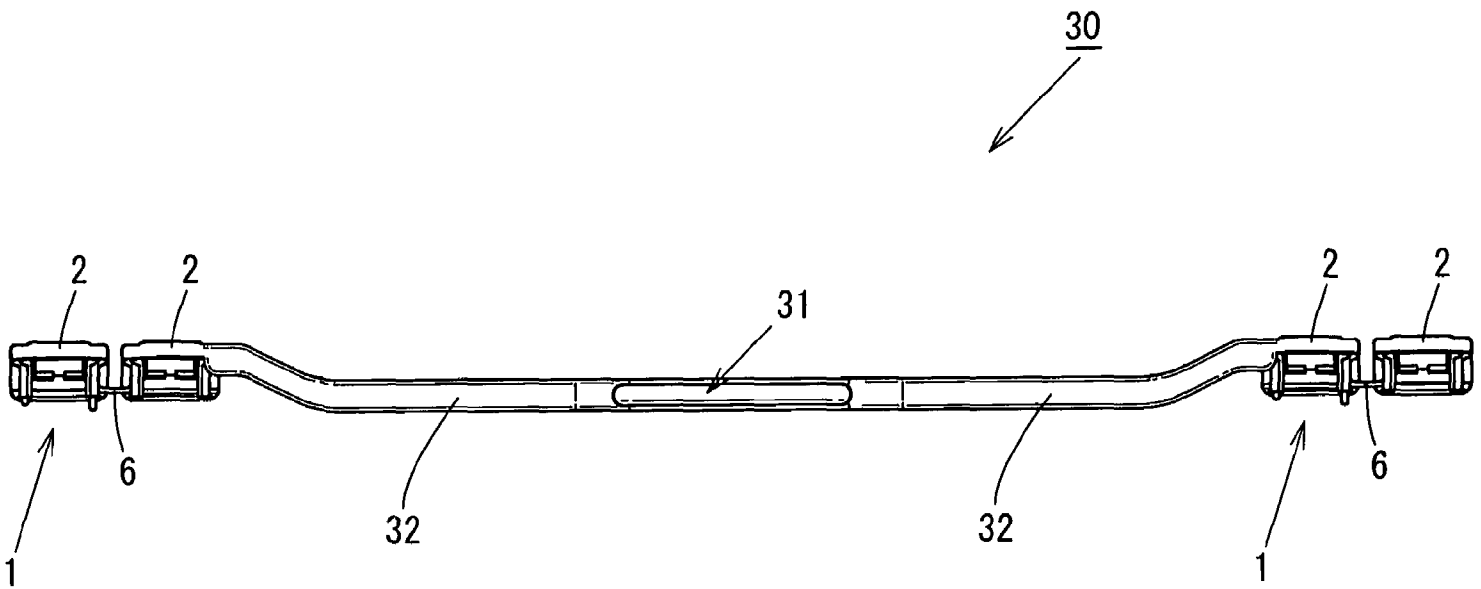
FIG. 11 is a plan view of the synthetic resin hanger equipped with synthetic resin clips.

FIG. 1 is a perspective view of a synthetic resin clip, FIG. 2 is a front view of the synthetic resin clip, FIG. 3 is a longitudinal sectional view of the synthetic resin clip, FIG. 4 is a plan view of the synthetic resin clip, FIG. 5 is a right side view of the synthetic resin clip, FIG. 6 is a left side view of the synthetic resin clip, and FIG. 7 is an exploded view of the synthetic resin clip prior to assembly, and in the figures, symbol 1 indicates the synthetic resin clip in its entirety.

This synthetic resin clip 1 is arranged by making a pair of clip members 2, formed of synthetic resin and to be of substantially the same shape, oppose each other face-to-face and by fitting a synthetic resin spring 3 across clip members 2.

As shown in FIGS. 3 and 7, synthetic resin spring 3 is formed of a composite material synthetic resin having high-density carbonate resin as the main component, and is formed to have an inverted "U" shape that is thick at a folded-back portion 3*a* and becomes gradually thinner at the tips 3*b*. At the inner surface of each tip 3*b* portion, a latching protrusion 4 is protruded to form a hook-like engaging portion 5.

As shown in FIG. 7, clip members 2, onto which synthetic resin spring 3 is fitted, are molded in a state wherein opposing surfaces 2*a* are laid side-by-side and are connected by a thin portion 6.

As shown in FIGS. 3, 5, and 6, each of clip members 2 has a clamping portion 7, which clampingly hold clothes, etc., formed at one end portion (the lower end portion), has a receiving portion 8, which receives an engaging portion 5 of the above-mentioned synthetic resin spring 3, formed at a substantially central portion, and has an operating portion 9, by which synthetic resin clip 1 is operated to open against the springing force of a synthetic resin spring 3, formed at the other end portion.

At side edge portions between the above-mentioned operating portion 9 and receiving portion 6, fulcrum portions 10 are formed so that the tip portions thereof contact each other as shown in FIGS. 4 and 5. At the contacting tip portions of fulcrum portions 10, a positioning portion 13 is formed, which comprises protrusions 11, which are formed on one of clip members 2, and holes 12, which are formed in the other clip member 2 and into which the above-mentioned protrusions 11 are fitted.

The above-mentioned thin portion 6, which connects the pair of clip members 2, is formed at a position to the side of positioning portion 13.

By the fitting of this positioning portion 13, the pair of clip members 2 that form the assembled synthetic resin clip 1 are prevented from shifting with respect to each other in the upper, lower, left, and right directions.

Also as shown in FIG. 3, each receiving portion 8 is formed by a hook-like protruding portion 14 that receives an engaging portion 5 of synthetic resin spring 3.

Here, since clip members 2 that are connected at thin portion 6 are formed by a pair of male and female dies (not shown) for forming the above-mentioned receiving portions 8, window holes 15 for sliding the molding dies are required for forming hook-like protruding portions 14.

As shown in FIGS. 1 to 3 and 7, each of window holes 15 of clip members 2 that oppose receiving portions 8 is provided with a fly-apart preventing bar 16 that prevents the flying apart of broken pieces of synthetic resin spring 3 when it breaks.

This fly-apart preventing bar 16 is positioned so as to cross a window hole 15 vertically at a substantially central position and at a thin width, and upper and lower end portions 16*a* and 16*b* thereof are respectively connected to upper and lower edges 15*a* and 15*b* of window hole 15. A fly-apart preventing portion 17 is formed by this fly-apart preventing bar 16 and a portion, extending from upper edge 15*a* of fly-apart preventing bar 16, to operating portion 9 and covering the folded-back portion 3*a* side of synthetic resin spring 3.

Sliding slits 18, for the dies that form the receiving portion 8 side surface of fly-apart preventing bar 16, are formed in receiving portion 8 that opposes fly-apart preventing bar 16.

As shown in FIG. 3, insertion spaces 19, for inserting the tip portions of synthetic resin spring 3, are formed in the direction of sliding of the dies (the horizontal direction in FIG. 3) between upper end portions 8*a* of receiving portions 8 and upper edges 15*a* of window holes 15 and fly-apart preventing bar 16.

In FIG. 3, symbol 20 indicates reinforcing ribs that are formed as two strips extending from the vicinity of lower edge 15*b* of the above-mentioned window hole 15 to the vicinity of an end portion (vertical end portion in FIG. 3) of clamping portion 7.

With synthetic resin clip 1, formed as described above, first, the respective clip members 2, which are molded integrally in the state of being connected at thin portion 6, are bent at thin portion 6, and surface portions 7*a* that form clamping portions 7 of synthetic resin clip 1 are made to contact each other.

When synthetic resin spring 3 is then inserted from above both clip members 2 and latching protrusions 4, formed on the inner surfaces of tip portions, are engaged with the respective receiving portions 8 of clip members 2, synthetic resin clip 1 is assembled.

With synthetic resin clip 1 that is thus assembled, operating portions 9 are operated to push apart clamping portions 7 against the elastic force of synthetic resin spring 3, and upon clamping a garment (not shown), the garment is passed through a needle inspector to perform needle inspection.

As such use of synthetic resin clips 1 is repeated, synthetic resin spring 3 becomes cracked due to secular change, etc., and becomes broken in some cases.

In regard to the location of such breakage, breakage tends to occur readily at portions 3*c* at which synthetic resin spring 3 becomes straight from folded-back portion 3*a,* the constricted base end portions of engaging portions 5 from the inner surface of which latching protrusions 4 are protruded, and other portions at which the shape of synthetic resin spring 3 changes since stress tends to concentrate at such locations. However, in all cases, broken pieces that tend to fly apart from window holes 15 due to breakage will be stopped definitely by fly-apart preventing bars 16 formed in window holes 15.

The flying apart of broken pieces can thereby be prevented and synthetic resin clip 1 having a high degree of safety can be provided.

Though in the present example, the pair of synthetic resin clip members 2 are enabled to be formed integrally by connecting with thin portion 6, this invention is not limited thereto, and each of clip members 2 may obviously be formed individually and then assembled.

With the above-described embodiment, the present invention can be applied as a clothespin in the case of a small clip and as a futon clip, used for drying a futon, in the case of a large clip.

Embodiment 2

As shown in FIGS. 8 to 11, this embodiment is a hanger 30, equipped with synthetic resin clips 1 of the above-described embodiment.

With this hanger 30, equipped with synthetic resin clips 1, one clip member 2, of the pair of clip members 2 connected by thin portion 6 as described with Embodiment 1, is integrally formed at each of both tip portions (left and right tip portions in FIG. 9) of an arm 32, with the arm 32 having a hanging hook 31 formed at a central portion.

That is as described above, in synthetic resin clip 1, engaging portions 5 are formed on inner surface portions of the tips of synthetic resin spring 3, which is formed in a "U" shape by being folded back at an intermediate portion. Window holes 15 for sliding of molding dies are formed on outer portions of clip members 2 in order to form receiving portions 8, which engage with engaging portions 5, at inner portions of clip members 2. Insertion spaces 19, into which the tip portions of synthetic resin spring 3 are inserted, are formed in the direction of sliding of the dies between upper edges 15*a* of window holes 15 and upper end portions 8*a* of receiving portions 8.

A fly-apart preventing bar 16 is then disposed across upper and lower edges 15*a* and 15*b* of each window hole 15, and engaging portions 5 of synthetic resin spring 3 are engaged with receiving portions 8 of the pair of clip members 2 that are made to oppose each other face-to-face.

In hanger 30 with synthetic resin clips of the above-described arrangement, hanger 30, in a state wherein a skirt, a pair of trousers, or other garment is clamped at the synthetic resin clip 1 portions, can be inspected by a needle inspector (not shown) at a manufacturer of the garments.

The actions and effects, especially the fly-apart preventing function of synthetic resin clips 1 provided on hanger 30 are the same as those of the above-described Embodiment 1.

In the figures, symbol 33 indicates a size indicator mounting portion, by which the size of the garment that is hung upon being clamped by synthetic resin clips 1 is indicated.

Though with the present embodiment, an example where the hook 31 portion of hanger 30 is formed integral to arm 32 is illustrated, this invention is not limited thereto, and obviously these components may be formed separately to make the hook 31 portion rotatable.

What is claimed is:

1. A synthetic resin clip, comprising:

a synthetic resin spring formed in a "U" shape by being folded back at an intermediate portion;

engaging portions formed on inner surface portions of tips of the synthetic resin spring, respectively;

a pair of clip members arranged such that inner surfaces of the clip members oppose each other, respectively;

receiving portions formed at inner portions of the clip members, respectively, the receiving portions projecting inwardly from the inner portions of the clip members, respectively;

window holes arranged on outer portions of the clip members so as to oppose the receiving portions, respectively, each of the window holes being shaped and arranged to receive a molding die for forming a respective opposing receiving portion;

insertion spaces extending between upper edges of the window holes and upper end portions of the receiving portions, respectively, the tip portions of the synthetic resin spring being inserted into the insertion spaces, respectively;

fly-apart preventing bars extending across the window holes, respectively, in a longitudinal direction of the clip members; and slots formed in the receiving portions so as to oppose the fly-apart preventing bars, respectively, the slots extending in a longitudinal direction of the receiving portions and being shaped and arranged to receive a die, wherein the engaging portions of the synthetic resin spring are engaged with the receiving portions of the pair of clip members, respectively, such that an end of each of the clip members are urged toward each other by a force of the synthetic resin spring.

2. The synthetic resin clip according to claim 1, wherein the pair of clip members are connectable by a bendable thin member bridging both clip members.

3. A hanger provided, at an arm having a hanging hook formed on a central portion of the arm, with synthetic resin clips, each synthetic resin clip comprising:

a synthetic resin spring formed in a "U" shape by being folded back at an intermediate portion;

engaging portions formed on inner surface portions of tips of the synthetic resin spring, respectively;

a pair of clip members arranged such that inner surfaces of the clip members oppose each other, respectively;

receiving portions formed at inner portions of the clip members, respectively, the receiving portions projecting inwardly from the inner portions of the clip members, respectively;

window holes arranged on outer portions of the clip members so as to oppose the receiving portions, respectively, each of the window holes being shaped and arranged to receive a molding die for forming a respective opposing receiving portion;

insertion spaces extending between upper edges of the window holes and upper end portions of the receiving portions, respectively, the tip portions of the synthetic resin spring being inserted into the insertion spaces, respectively;

fly-apart preventing bars extending across the window holes, respectively, in a longitudinal direction of the clip members; and slots formed in the receiving portions so as to oppose the fly-apart preventing bars, respectively, the slots extending in a longitudinal direction of the receiving portions and being shaped and arranged to receive a die, wherein the engaging portions of the synthetic resin spring are engaged with the receiving portions of the pair of clip members, respectively, such that an end of each of the clip members are urged toward each other by a force of the synthetic resin spring.

4. The hanger with synthetic resin clips according to claim 3, wherein each pair of clip members is connectable by a bendable thin member bridging both clip members, and wherein one clip member of each pair of clip members is integrally molded to a tip portion of the arm.

* * * * *